US005178553A

United States Patent [19]

Hatagishi et al.

[11] Patent Number: 5,178,553

[45] Date of Patent: Jan. 12, 1993

[54] LEVER-OPERATED CONNECTOR ASSEMBLY

[75] Inventors: Yuji Hatagishi; Naoto Taguchi, both of Shizuoka, Japan

[73] Assignee: Yazaki Corporation, Tokyo, Japan

[21] Appl. No.: 850,900

[22] Filed: Mar. 13, 1992

[30] Foreign Application Priority Data

Mar. 15, 1991 [JP] Japan ..... 3-51213

[51] Int. Cl.[5] ..... H01R 13/00

[52] U.S. Cl. ..... 439/157

[58] Field of Search ..... 439/152-160

[56] References Cited

U.S. PATENT DOCUMENTS 2,987,693 6/1961 Wamsley ..... 439/157

5,035,634 7/1991 Hasircoglu et al. ..... 439/157

*Primary Examiner*—Joseph H. McGlynn

*Attorney, Agent, or Firm*—Sughrue Mion Zinn Macpeak & Seas

[57] ABSTRACT

A lever-operated connector assembly in which driven pins are provided on the side walls of a male housing which are perpendicular to the longitudinal direction of the male housing, pin guide grooves are formed in the side walls of a hood of a female housing which is to be engaged with the male housing, levers having cam grooves which are engaged with the driven pins being confronted with the pin guide grooves are swingably provided, the outermost of the levers are coupled to each other with a lever handle, the levers are turned so that the male housing and the female housing are engaged with or disengaged from each other. In the lever-operated connector assembly, the male housing and the hood are divided into at least two small male housings and at least two small hoods in a longitudinal direction, respectively, and the driven pins are provided on each of the small male housings, and the pin guide grooves are formed in each of the small hoods. Furthermore, temporary locking means are provided for the small male housings and the small hoods, and additional levers having cam grooves are coupled to the middle portion of the lever handle in correspondence to the positions of division of the male housing and hood.

3 Claims, 4 Drawing Sheets

LEVER-OPERATED CONNECTOR ASSEMBLY

BACKGROUND OF THE INVENTION

This invention relates to a lever-operated connector assembly in which a lever is turned to connect a male housing and a female housing with each other or disconnect them from each other.

A lever-operated connector assembly of this type has been disclosed by Japanese Utility Model Unexamined Publication No. Sho. 58-178289. The connector assembly comprises an outer connector and an inner connector. One of the connectors has engaging protrusions, while the other has an engaging lever. The lever is turned to engage with or disengage from the engaging protrusion, thereby to cause the inner and outer connectors to engage with or disengaged from each other.

The above-described conventional lever-operated connector assembly is as shown in FIG. 5. In the figure, reference character a designates a female connector connected directly to a printed wiring board p for a computer circuit; and b, a male connector. The male connector b has right and left walls each of which has a protrusion b1. The female connector a also has right and left walls each having a guide groove a1 which is engaged with the protrusion b1. The female connector a is provided with a lever c having cam grooves c1. The male connector and the female connector are connected with each other or disconnected from each other by turning the lever c.

As was described above, the lever-operated connector assembly shown in FIG. 5 has the lever c. Hence, it is advantageous in that the male and female connectors can be connected with each other or disconnected from each other with a smaller force than in the case of an ordinary connector assembly. However, in the case of a multi-pole connector which has a large number of terminals d and is elongated laterally, in order to connect the male and female connectors, it is necessary to push the terminals with a force greater than the mechanical strength of the connector housing. Hence, in this case, the middle portion of the male connector b is curved as shown in FIG. 6, so that the terminals are not sufficiently engaged with the mating terminals.

SUMMARY OF THE INVENTION

In view of the foregoing, an object of this invention is to provide a lever-operated connector assembly in which, when the lever is turned, the male and female connectors are not curved, and therefore the male and female terminals are connected with high reliability.

Another object of this invention is to provide a lever-operated connector assembly in which a male housing is engaged with or disengaged from a female housing by operating a lever; in which, even if the housings are laterally elongated having a large number of terminals, the force applied thereto by the lever is uniformly distributed so that the engagement and disengagement of the male and female housings can be achieved smoothly.

The above-described problem accompanying a conventional lever-operated connector assembly has been solved by the provision of a lever-operated connector assembly in which driven pins are provided on the side walls of a male housing which are perpendicular to the longitudinal direction of the male housing, pin guide grooves are formed in the side walls of a hood of a female housing which is to be engaged with the male housing, levers having cam grooves which are engaged with the driven pins being confronted with the pin guide grooves are swingably provided, the outermost of the levers are coupled to each other with a lever handle, the levers are turned so that the male housing and the female housing are engaged with or disengaged from each other; in which, according to the invention, the male housing and the hood are divided into at least two small male housings and at least two small hoods in a longitudinal direction, respectively, the driven pins are provided on each of the small male housings, and the pin guide grooves are formed in each of the small hoods, temporary locking means are provided for the small male housings and the small hoods, additional levers having cam grooves are coupled to the middle portion of the lever handle in correspondence to the positions of division of the male housing and hood, and with the small male housings temporarily locked to the small hoods with the temporary locking means, the levers are turned so that the small male housings are engaged with the small hoods at the same time (hereinafter referred to as "a first arrangement of the invention", when applicable).

Another means for solving the problem is a lever-operated connector assembly in which driven pins are provided on the side walls of a male housing which are perpendicular to the longitudinal direction of the male housing, pin guide grooves are formed in the side walls of a hood of a female housing which is to be engaged with the male housing, levers having cam grooves which are engaged with the driven pins being confronted with the pin guide grooves are swingably provided, the outermost of the levers are coupled to each other with a lever handle, the levers are turned so that the male housing and the female housing are engaged with or disengaged from each other; in which, according to the invention, at least one dividing groove is formed in a longitudinally extended wall of the male housing in such a manner that the dividing groove is extended in the direction of engagement and divides the male housing, a reinforcing board is connected to the lever handle in such a manner that the reinforcing board is engageable with the dead-end wall of the dividing groove, and a slit is formed in the hood to allow the reinforcing board to go in and out of the slit (hereinafter referred to as "a second arrangement of the invention", when applicable).

In the lever-operated connector assembly according to the first arrangement of the invention, the male housing and the hood of the female housing coupled to the male housing are divided into the small male housings and the small hoods, respectively, and the small male housings are engaged with the small hoods, respectively. Hence, the lever-operated connector assembly is free from the difficulties accompanying the conventional lever-operated connector assembly that, when the male connector is engaged with the female connector, the male connector is curved and the terminals thereof are not sufficiently connected to the mating terminals. Furthermore, in the lever-operated connector of the invention, the small male housings are inserted into the respective small hoods, and the former are temporarily locked to the latter. Hence, the small male housings will not come off the small hoods during connecting operation, and the former can be engaged with (or disengaged from) the small hoods at the same time by turning the lever.

In the lever-operated connector assembly according to the second arrangement of the invention, the reinforcing boards provided between the right and left levers serve as cam plates. Therefore, similarly as in the lever-operated connector assembly according to the first invention, the bending of the connector is prevented. In the lever-operated connector assembly, unlike the lever-operated connector assembly according to the first invention, the male housing is not divided, and therefore the engagement of the male and female housings can be achieved in one action.

DETAILED DESCRIPTION OF THE PREFERRED EMBODIMENTS

Figure 1:
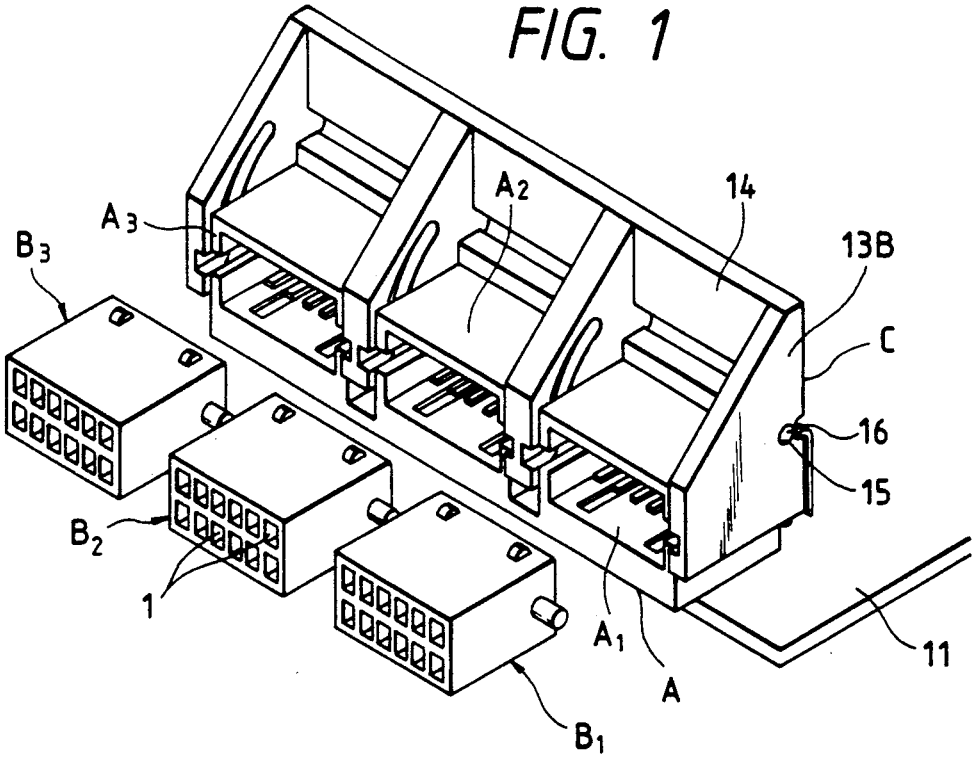
FIG. 1 is a perspective view showing a lever-operated connector assembly according to a first arrangement of the invention.
Figure 2:
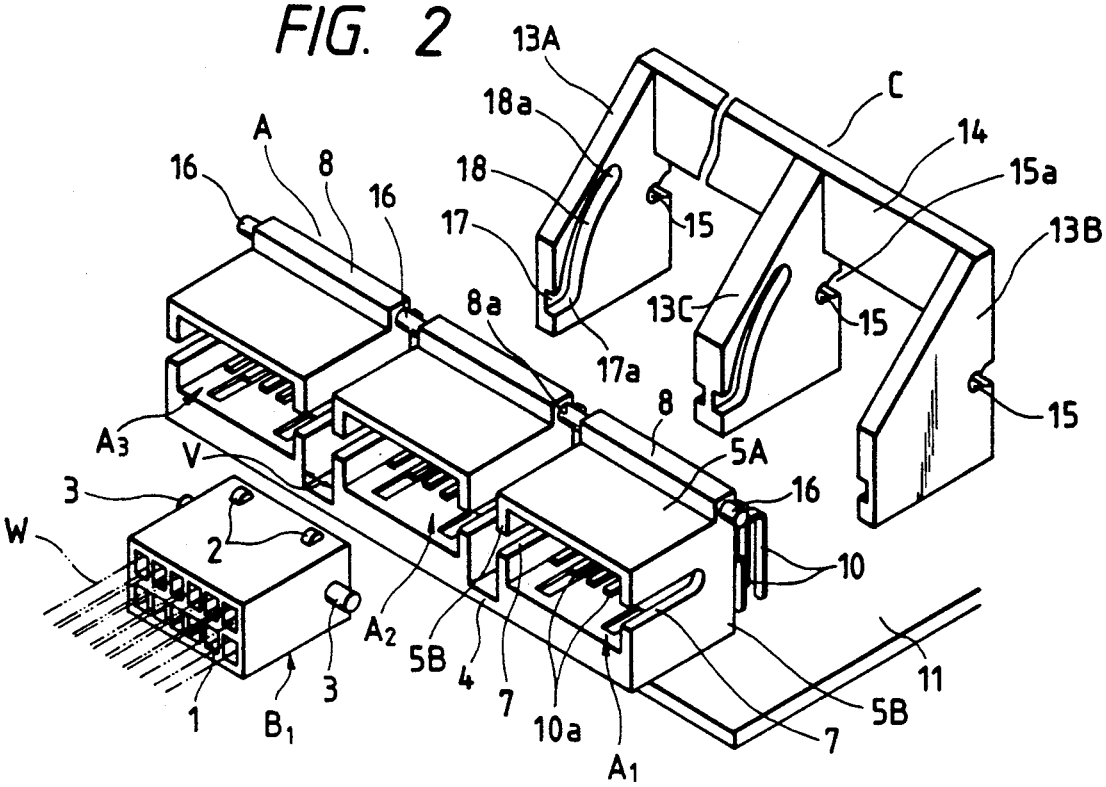
FIG. 2 is an exploded perspective view showing essential components of the lever-operated connector assembly shown in FIG. 1.

FIGS. 1 and 2 show an example of a lever-operated connector assembly, which constitutes a first arrangement of this invention. In these figures, reference character A designates a female housing of synthetic resin which is connected directly to a printed wiring board 11; B1, B2 and B3, small male housings; and C, a lever member. The female housing A is an elongated multipole connector housing, and has a plurality of small hoods (three small hoods A1, A2 and A3 in the case of FIGS. 1 and 2) which are engaged with the mating male housings, respectively. These small hoods are arranged with a suitable gap V therebetween and are integral with a common base board 4. The small male housings B1 through B3 are formed in compliance with the number and size of the small hoods Al through A3.

Each of the small male housings B1 through B3 has a plurality of terminal accommodating chambers 1 which accommodate female terminals (not shown) connected to wires W. Each small male housing further has temporary locking protrusions 2 on the top wall, and driven pins 3 on the right and left side walls.

Each of the small hoods A1 through A3 has a locking portion 6 on the inner surface of its upper wall 5A along the front edge so as to be engaged with the temporary locking protrusions 2, and pin guide grooves 7 and 7 which are formed in the right and left walls 5B and 5B so as to be engaged with the driven pins 3. Furthermore, each small hood has a bearing portion 8 with a shaft hole **8*a* which is formed on the upper surface of the top wall 5A along the rear edge. In addition, each small hood has an end wall 5*c* having a number of terminal inserting holes 9 (cf. FIG. 3A). The male terminal end portions 10*a* of L-shaped terminals 10 connected to circuit conductors 12 on a printed wiring board 11 are inserted into the terminal inserting holes 9 of the end wall 5C** of each small hood.

The lever member C comprises: a plurality of plate-shaped levers arranged in parallel, namely, right and left levers 13A and 13B and intermediate levers 13C, 13C', . . . between the right and left levers; and a lever handle 14 connected to those levers. The levers have shaft holes 15 serving as rotary axis. On the other hand, a pin-shaped shaft 16 is inserted into the shaft holes **8*a* of the bearing portions 8 of the small hoods A1 through A3, and is engaged with the shaft holes 15 of the levers so that the levers are swingable about the pin-shaped shaft 16. Furthermore, each of the levers has a lead-in groove 15*a* in such a manner that it is communicated with the respective shaft hole 15 and opened outwardly. Hence, the lever member C can be coupled to the pin-shaped shaft 16 from the outside. The pin-shaped shaft 16 may be formed integral with the small hoods A1 through A3**.

In the inner surface of each of the right and left levers 13A and 13B, a lead-in groove 17 for receiving the driven pin 3 and a cam groove 18 are formed in such a manner that those grooves 17 and 18 form one groove. More specifically, the lead-in groove 17 is so formed that it is in alignment with and in parallel with the pin guide groove 7 when the respective lever (13A or 13B) is held raised. The cam groove 18 is formed along an elliptic curve which is continuously changed in the distance from the rotary axis (or the shaft hole 15) in such a manner that its finish end **18*a* is closest to the shaft hole 15 and its start end (the end 17*a* of the lead-in groove) is furthest from the shaft hole 15. Each of the intermediate levers 13C, 13C', . . . has the above-described lead-in groove 17 and the cam groove 18** in each of both surfaces.

Figure 3A:
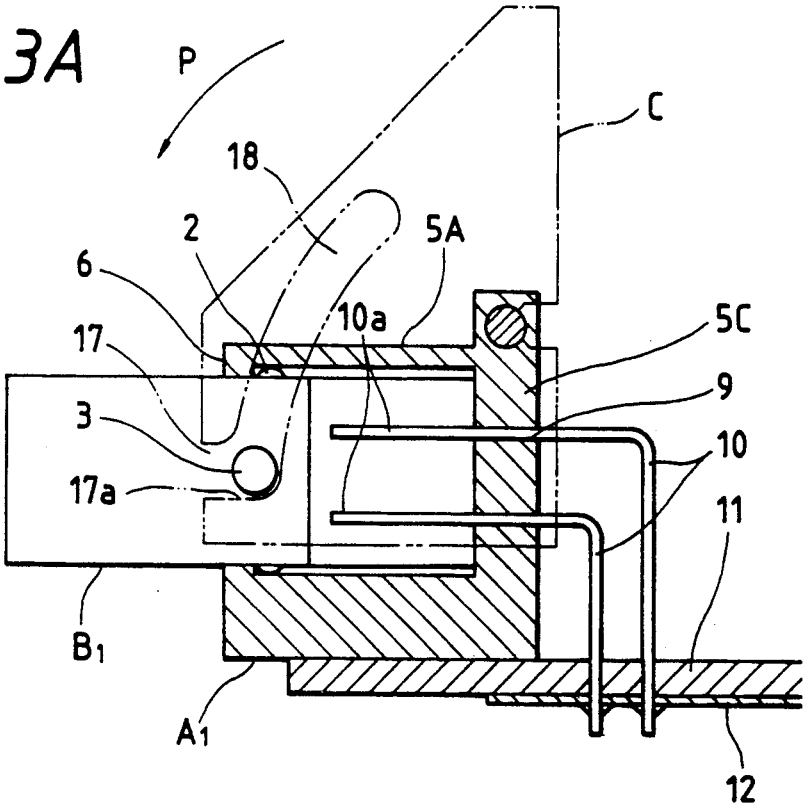
FIG. 3A is a sectional view showing small male housings which are going to be engaged with small hoods.

As shown in FIG. 3A, the small male housings B1 through B3 are inserted into the small hoods Al through A3, respectively, with the lever member C held raised, and the former are temporarily locked to the latter with the temporary locking protrusions 2 locked to the locking portions 6. In this operation, the driven pins 3 on the side walls of the small male housings are caused to go in the pin guide grooves 7 of the respective hoods Al through A3 and the lead-in grooves 17 of the respective levers 13A, 13B, 13C,..., and reach the ends **17*a* of the lead-in grooves 17 (or the inlets of the cam grooves 18). Under this condition, the male terminal end portions 10*a* of the L-shaped terminals 10** are not engaged with the mating female terminals yet.

Figure 3B:
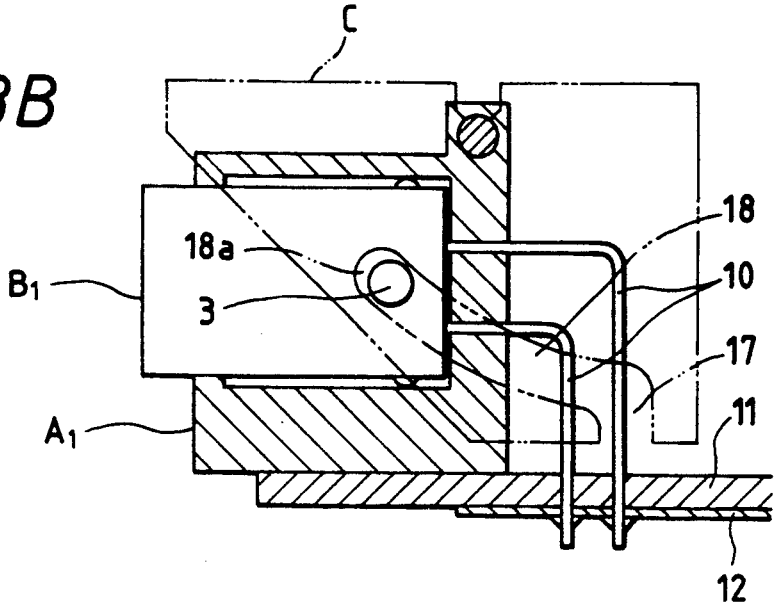
FIG. 3B is a sectional view showing the small male housings which have been engaged with the small hoods.

After the small male housings have been temporarily locked to the small hoods, respectively, as was described above, the lever member C is turned forwardly; i.e., in the direction of the arrow P (FIG. 3A). Since the driven pins 3 have been engaged with the cam grooves 18, the small male housings are pushed towards the end walls 5C of the small hoods. FIG. 3B shows the small housings engaged completely with the small hoods forming the female housing A with the cam member C turned about 90°.

Figure 6:
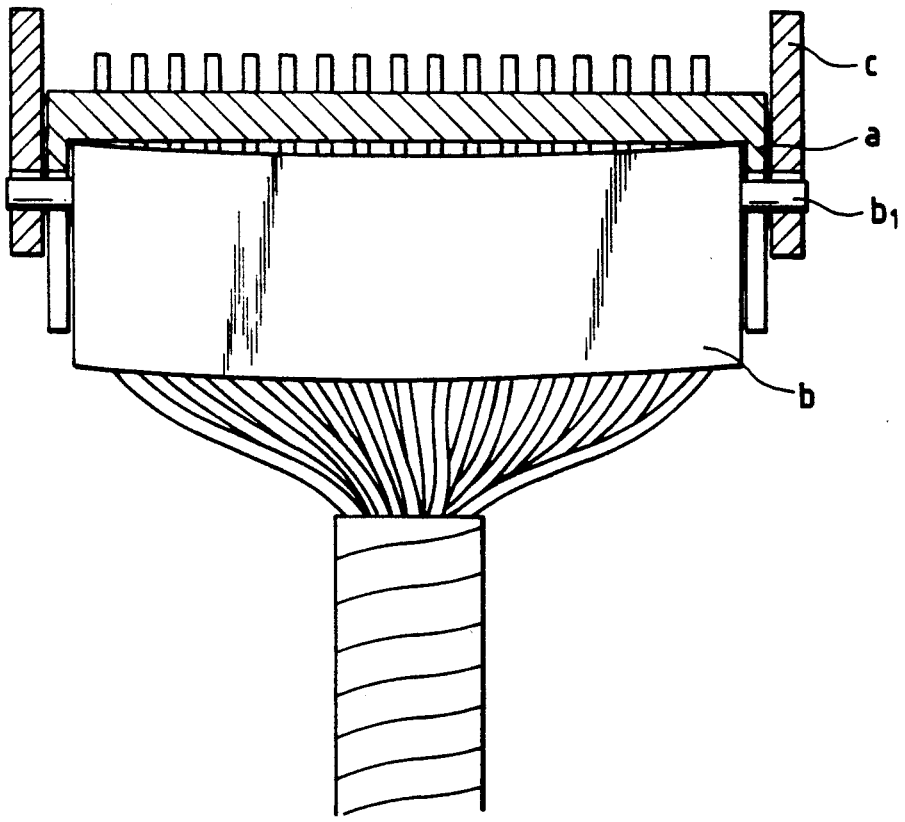
FIG. 6 is a plan view of a male housing engaged with a female housing in the conventional lever-operated connector assembly shown in FIG. 5.

When the lever member C is turned, lever action is applied to the small male housings B1 through B3 by the pairs of levers 13A and 13C, 13C and 13C', and 13C' and 13B. Hence, the small male housings are smoothly engaged with the small hoods, respectively. This eliminates the difficulty accompanying the conventional lever-operated connector assembly that, as shown in FIG. 6, the force applied to the connector by the lever C is not uniform. The small male housings can be disengaged from the small hoods by turning the lever C in the opposite direction. In this operation, the former is smoothly disengaged from the latter.

Figure 4:
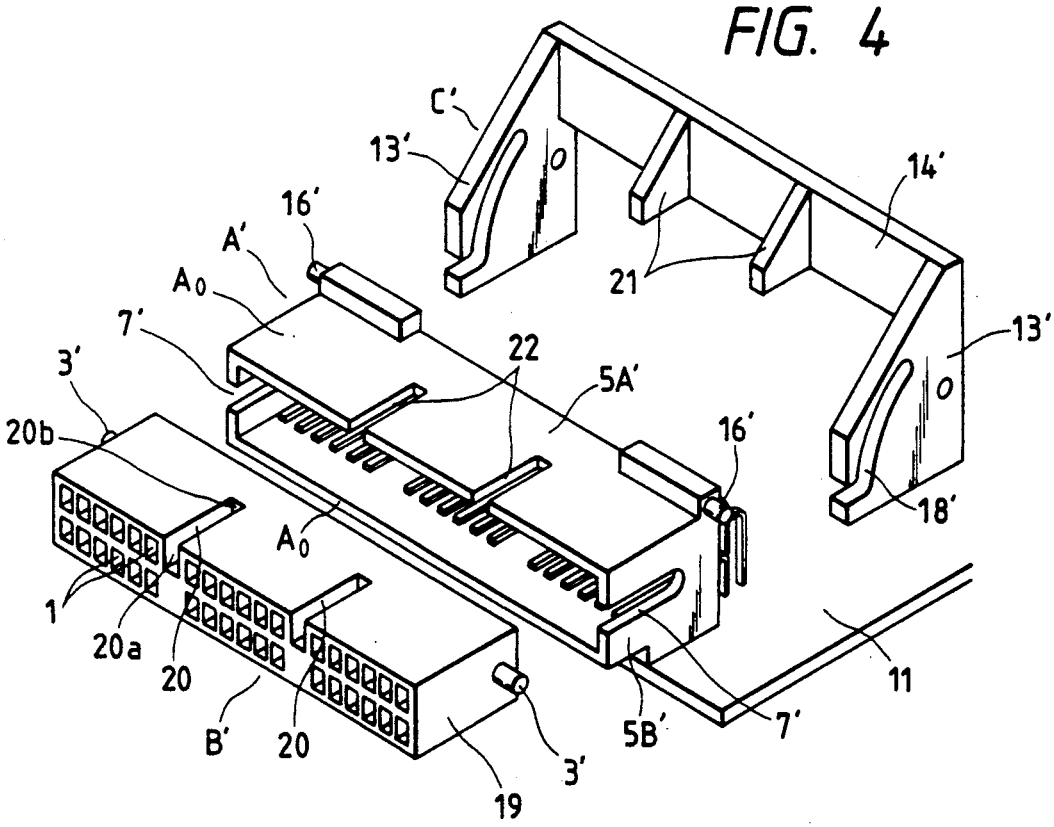
FIG. 4 is a perspective view showing a lever-operated connector assembly according to a second arrangement of the invention.
Figure 5:
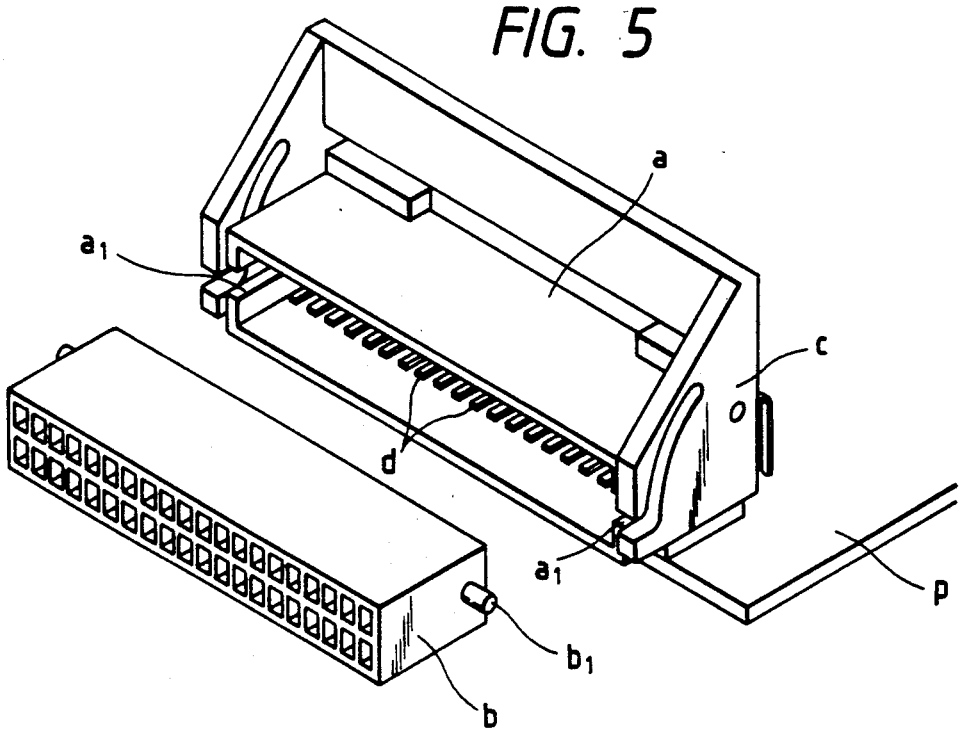
FIG. 5 is a perspective view showing a conventional lever-operated connector assembly.

FIG. 4 shows another example of the lever-operated connector assembly, which constitutes a second embodiment of the invention. In the second embodiment, similarly as in the above-described conventional lever-operated connector assembly shown in FIG. 5, its female housing A' and male housing B' are of an elongated multi-pole connector. A cam member C' is formed by connecting a pair of levers 13' with cam grooves 18' to a lever handle 14'. The cam member C' is supported by pin-shaped shafts 16' in such a manner that it is swingable with respect to the right and left walls 5B' and 5B' of the hood A0 of the female housing A'. Further in FIG. 4, reference character 3' designates driven pins which are engaged with the cam grooves 18' of the lever member C'; and 7', pin guide grooves.

A plurality of dividing grooves 20 (two dividing grooves 20 in the case of FIG. 4) are formed in the elongated top wall of the male housing B' in such a manner that the dividing grooves 20 are extended in the direction of engagement of the connector. More specifically, each of the dividing grooves 20 is opened at one end, on the side of the male housing B' where wires are connected, and forms a dead-end wall **20*b*** at the other end.

In correspondence to the dividing grooves 20 of the male housing B', reinforcing boards 21 serving as cam plates are extended from the lever handle 14' of the lever member C', and slits 22 are cuts in the top wall 5A' of the hood A0 so that the reinforcing boards 21 are allowed to go in and out of the slits 22.

In the embodiment, as the cam member C' is turned, the driven pins 3' on the right and left walls of the male housing B' are engaged with the cam grooves 13' while the reinforcing boards 21 between the right and left walls of the lever member are engaged with the dead-end walls **20*b* of the dividing grooves 20. Hence, in this operation, the force of the cam member C' applied to the male housing is uniformly distributed. Therefore, similarly as in the above-described first embodiment, the male housing is smoothly connected to the female housing. Furthermore, the second embodiment, unlike the first embodiment, is free from the troublesome operation of temporarily locking the small male housings B1 through B3**.

As was described above, the lever-operated connector assembly of the invention is free from the difficulty that, when the laterally elongated multi-pole connectors are engaged with each other by turning the lever, the middle portion of the male connector housing (or the male connector) is curved so that the male terminals are not sufficiently connected to the female terminals. That is, in the lever-operated connector assembly of the invention, the force of the lever is uniformly distributed, and the male terminals and female terminals are therefore smoothly connected.

What is claimed is:

1. A lever-operated connector assembly in which driven pins are provided on lateral side walls of a male housing, pin guide grooves are formed in lateral side walls of a hood of a female housing which is to be engaged with said male housing, levers having cam grooves which are engaged with said driven pins being confronted with said pin guide grooves are swingably provided, the outermost of said levers are coupled to each other with a lever handle, said levers are turned so that said male housing and said female housing are engaged with or disengaged from each other; said lever-operated connector assembly comprising an improvement wherein:

said male housing and said hood are laterally divided into at least two small male housings and at least two small hoods, respectively;

said driven pins are provided on each of said small male housings, and said pin guide grooves are formed in each of said small hoods;

temporary locking means are provided for said small male housings and said small hoods;

additional levers having cam grooves are coupled to the middle portion of said lever handle in correspondence to the positions of division of said male housing and hood; and with said small male housings temporarily locked to said small hoods with said temporary locking means, said levers are turned so that said small male housings are engaged with said small hoods at the same time.

2. The connector assembly according to claim 1, wherein said temporary locking means includes locking protrusions formed on a top wall of each of said small male housings, and a locking portion formed on an inner surface of an upper wall of each of said small hoods along a front edge thereof.

3. A lever-operated connector assembly in which driven pins are provided on lateral side walls of a male housing, pin guide grooves are formed in lateral side walls of a hood of a female housing which is to be engaged with said male housing, levers having cam grooves which are engaged with said driven pins being confronted with said pin guide grooves are swingably provided, the outermost of said levers are coupled to each other with a lever handle, said levers are turned so that said male housing and said female housing are engaged with or disengaged from each other; said lever-operated connector assembly comprising:

at least one dividing groove formed in a wall of said male housing which connects said lateral side walls thereof, each dividing groove extending in the direction of engagement and dividing said male housing;

a reinforcing board connected to said lever handle in such a manner that said reinforcing board is engageable with the dead-end wall of each dividing groove; and a slit formed in said hood to allow each reinforcing board to go in and out of said slit.

* * * * *